US005713451A

United States Patent [19]

Masse

[11] Patent Number: 5,713,451

[45] Date of Patent: Feb. 3, 1998

[54] AUTOMATIC PRODUCT DISPENSING DEVICE EQUIPPED WITH A COIN MECHANISM

[75] Inventor: Bernard Masse, Tourcoing, France

[73] Assignee: Remy Lenfant Et Cie, Hem, France

[21] Appl. No.: 454,225

[22] PCT Filed: Apr. 6, 1994

[86] PCT No.: PCT/FR94/00387

§ 371 Date: Dec. 18, 1995

§ 102(e) Date: Dec. 18, 1995

[87] PCT Pub. No.: WO94/24686

PCT Pub. Date: Oct. 27, 1994

[30] Foreign Application Priority Data

Apr. 6, 1993 [FR] France ..... 93 04290

[51] Int. Cl.[6] ..... G07F 1/04

[52] U.S. Cl. ..... 194/202; 194/345; 194/347; 194/351

[58] Field of Search ..... 194/202, 321, 194/342, 345, 347, 351, 317

[56] References Cited

U.S. PATENT DOCUMENTS 4,416,364 11/1983 Bellis et al. ..... 194/319

FOREIGN PATENT DOCUMENTS

| | | | |
|---|---|---|---|
| 2406263 | 5/1979 | France . | |
| 2744945 | 4/1979 | Germany . | |
| 2753377 | 5/1979 | Germany . | |
| 3806576 | 2/1989 | Germany . | |
| 54-20797 | 2/1979 | Japan | 194/345 |
| 646000 | 10/1984 | Switzerland | 194/351 |
| 2257810 | 1/1993 | United Kingdom | 194/345 |

*Primary Examiner*—F. J. Bartuska

*Attorney, Agent, or Firm*—Harrison & Egbert

[57] ABSTRACT

An automatic product dispensing device including a coin mechanism for the insertion of at least one coin, tokens or the like and a mechanism for discharging extraneous items. A mechanism is provided for checking correct operation acting upon a mechanism for controlling the discharge. The discharge mechanism is formed by a chute having a body formed by at least one portion including two flaps of which one is articulated. At least one electromagnet acts upon the articulated flap.

8 Claims, 4 Drawing Sheets

1
2
29
8
20
20a
19b
16b
16
21
6
15
14
16a
15
18
17
19a
13
20b
13
24
11
26
25
B
23
II
II
12
3
27
10

A
2
29
1
10
8
20a
20
19b
16b
16
21
6
15
14
16a
15
18
17
19a
19
13
20b
13
11
23
9
26
10
7
12
4
3
24
27
A

AUTOMATIC PRODUCT DISPENSING DEVICE EQUIPPED WITH A COIN MECHANISM

TECHNICAL FIELD

The present invention relates to an automatic product dispensing device including a coin mechanism for the insertion of at least one coin, tokens or the like, and means for dispensing the products. It will find an application in all those sectors of economic activity in which use is made of such dispensing devices for dispensing various products such as articles of confectionery, cigarettes, beverages and other items, and which are designed to be placed in public places such as, for example, the halls of stations and airports, the foyers of hotels, in the street, etc.

BACKGROUND ART

At the present time, such dispensing devices have a housing inside in which are disposed products to be dispensed which are accessible via a drawer after the insertion into a coin mechanism of a sum of money in coins corresponding to the purchase price of the the product that desired.

It is known to equip such dispensing devices with coin mechanisms that are capable of discharging coins in the event of internal jamming, or again, of discharging them when they are determined be invalid.

For example, document DE-A-2.744.945 discloses a device for testing and checking coins introduced into a coin mechanism. It should be noted, however, that this document is concerned solely with the circulation of the coins and its structure in no way permits the ejection of extraneous items such as pieces of crumpled paper, folded cardboard, etc . . . other than the coins or analogous items.

In practice, although they are simple to use, such dispensing devices have the disadvantage of being rendered unserviceable through the introduction into the coin mechanism of foreign objects, such as pieces of paper, cardboard, bottle caps, metal objects or others.

Under these circumstances, it is necessary, in order to restore the dispensing device to working order, to call on the services of a specialist, who has to work on the structure of the coin mechanism in order to remove the foreign objects therefrom.

Pending the specialist's visit, the condition of the dispensing device is such that it does not permit the dispensing of its products which is, understandably, of great inconvenience to the users.

Furthermore, a visit by a specialist in order to restore such dispensing devices to working order is costly, which increases the cost of using such apparatus.

From document DE-A-3.806.576 there is known a product dispensing device including a coin mechanism for the introduction of at least one coin, token or the like and means for substantially discharging the coin, token or the like, if it proves not to be the item awaited, provided with means for checking correct operation, acting upon means for controlling the discharge means.

The the novel of this invention resides in the device for selecting the items such as coins, tokens or the like, behind the orifice of the coin mechanism. Indeed, after insertion into the apparatus, the item comes back out of the slot in the coin mechanism through which it has been inserted, if it is unsuitable or, on the contrary, if it is suitable, the device opens a hatch so that the item can continue on its way.

It is to be noted that the device disclosed in this document is completely ineffective as regards the discharge of any extraneous item, whatever its shape or consistency, other than a coin, tokens or the like, that is to say, for example, pieces of crumpled paper, pieces of folded cardboard, etc.

The object of the present invention is to overcome the drawbacks of presently known dispensing devices by providing a dispensing device which enables the coin mechanism to be unblocked, and which permits the removal of foreign bodies inside the coin mechanism without necessitating action by skilled personnel and thus the shutdown of the dispensing device.

One of the objects of the present invention is to provide a coin mechanism according to the invention that is simple in design and which can be fitted on any type of existing dispensing device, thereby increasing their potential use.

One advantage of the means equipping a dispensing device according to the invention is that it can be brought into operation manually or via electronic timing means, which facilitates its implementation.

Another object of the present invention is to provide a dispensing device that further limits the ability to insert foreign bodies into the coin mechanism.

Another object of the present invention is to provide a dispensing device that can be mass produced from standard elements, which reduces their manufacturing cost.

Further objects and advantages of the present invention will emerge in the course of the following description, which is given solely by way of example and is not intended to limit the said invention.

SUMMARY OF THE INVENTION

For this purpose, the automatic product dispensing device, including a coin mechanism for the introduction of at least one coin, tokens or the like, and product dispensing means, as well as means for discharging any extraneous items other than coins, tokens or the like, provided with checking means, acting upon means for controlling the discharge means, is characterized in that the discharge means is formed by a chute having a body formed by a portion comprising two flaps of which at least one is articulated.

According to another feature of the invention, the dispensing device comprises, upstream of the discharge means, means for selecting the the extraneous items.

DETAILED DESCRIPTION OF THE INVENTION

Figure 2:
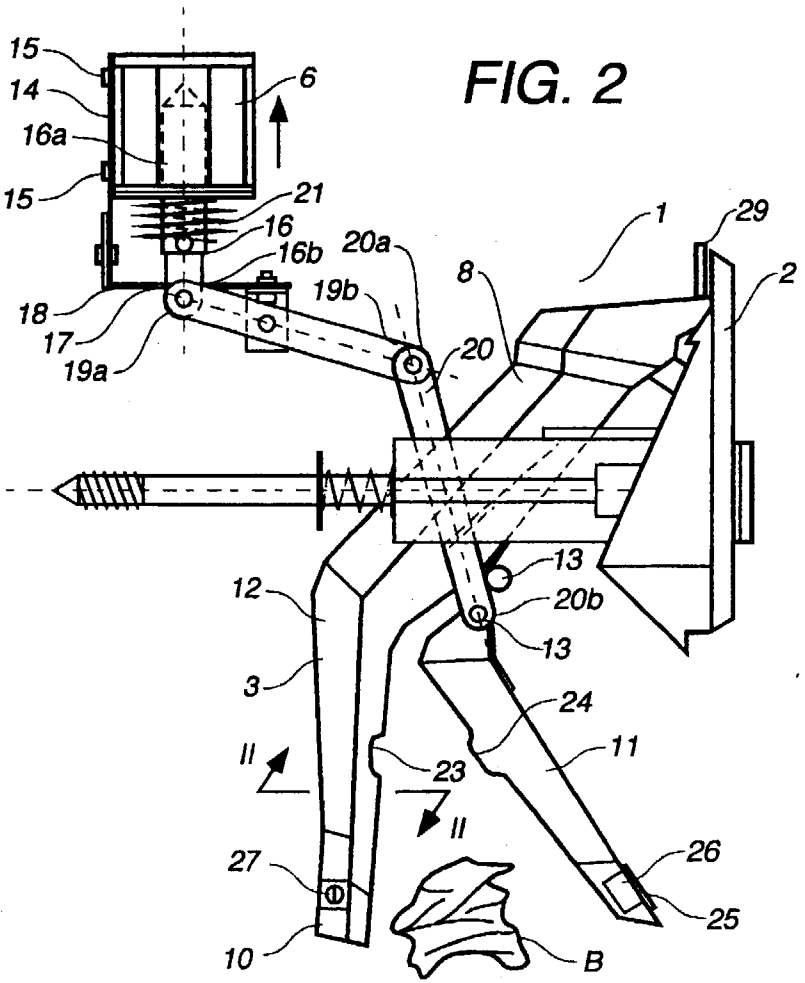
FIG. 2 is a schematic view similar to that of FIG. 1, illustrating the product dispensing device equipped with unblocking means comprising a chute in open position.

The present invention relates to an automatic product dispensing device, including a coin mechanism for the insertion of at least one coin, tokens or the like, and product distribution means.

It will find an application in all sectors of economic activity in which use is made of such dispensing devices for dispensing various products such as cigarettes, articles of confectionery, beverages or other items and, in particular, in the halls of public places such as stations and airports, the foyers of hotels or in the street.

At the present time, automatic product dispensing devices are Formed by a housing inside which are placed products that it is wished to dispense and which are accessible, for example, via at least one drawer, the operation of which can be actuated after the insertion into a coin mechanism of a certain sum of money in the form of coins or of tokens corresponding to the price of the product that one wishes to acquire.

According to the invention, the automatic dispensing device comprises a coin mechanism 1 which has an area 2 for the insertion of at least one coin A, communicating with a chute 3, as well as means for dispensing and releasing the the products of a conventional type.

According to the invention, to permit the unblocking of the device in the event of foreign bodies B, such as pieces of paper, cardboard, bottle tops or other items being introduced, it comprises means 4 for discharging all extraneous items B, other than the coins, tokens or analogous items, provided with means of checking correct operation acting upon means 6 for controlling the the discharge means 4.

As to the discharge means 4, these are constituted by a chute 3 which, according to the invention, comprises, in particular, a substantially V-shaped body 7, composed of three portions, namely an upper portion 8, a mid portion 9 and a lower portion 10.

Figure 7:
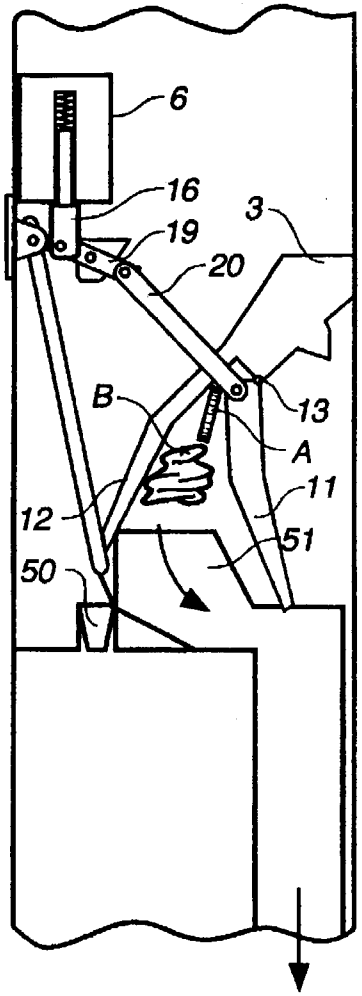
FIG. 7 shows the device represented in FIG. 6 with the said chute open for unblocking.
Figure 6:
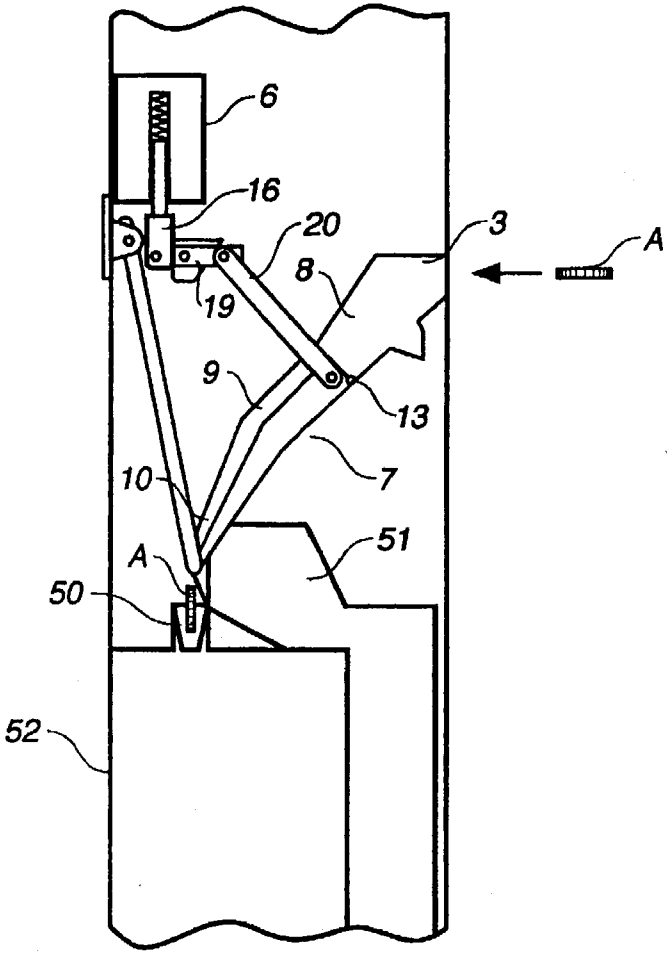
FIG. 6 shows another variant of the device according to the present invention in a view similar to that of figure 1.

The upper portion 8 comprises an orifice which emerges opposite a horizontal slot in the area 2 for the introduction of at least one coin A. The mid portion 9 takes the form of two flaps, 11 and 12, one, 11, of which articulates about a hinge 13, possibly assisted by a pin or other type of spring to improve the closure of the chute. As can be seen in FIGS. 6 and 7, the lower portion 10 can be adjacent an input slot 50 of the coin mechanism 52. Lower portion 10 is also movable so as to be adjacent an area 51 for the storage and/or discharge of the extraneous items B.

Figure 8:
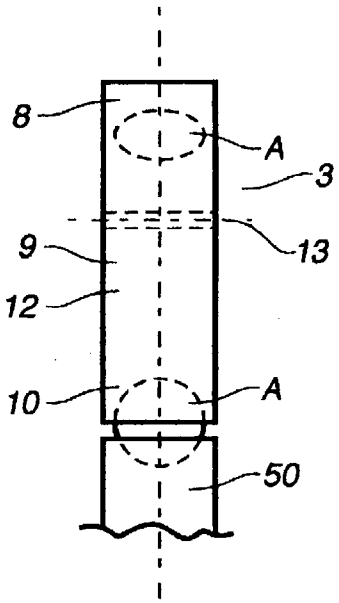
FIG. 8 is a partial view of the left-hand side of the chute illustrated in FIGS. 6 and 7.

One should note the advantageous arrangement of the two said flaps 11, 12, which can move away from one another in the plane of the coin, with the latter sliding, still flat, substantially horizontally, along the chute 3. The axis of hinge 13 is, for its part, transverse to the chute and to the direction of sliding of the coin along the chute, as more particularly illustrated in FIG. 8.

In order to avoid the retention and blocking of extraneous items and foreign bodies, the body 7 of the chute does not have an orifice which can be jammed. As such, it lacks the area most likely to accumulate and retain these extraneous items and foreign bodies. Thusly, the present invention avoids the situation leading to the shutdown of the automatic dispensing device and leading to repair action by a specialist.

The control means is formed by an electromagnet 6 fixed to a supporting spacer 14, via screws 15 on one of the walls of the housing of the automatic dispensing device.

This electromagnet 6 is integral, the end **16*a* of a rod 16 capable of being mounted slidingly in vertical translation and the other end, 16*b*, of which emerges in an orifice 17 provided in a spacer 18 integral with spacer 14, being secured, to one of the ends 19*a* of a first link 19, the other end, 19*b*, of which is secured to one of the ends 20*a* of a second link 20, the other end, 20*b*, of which is secured to the articulated flap 11** of the chute.

Figure 1:
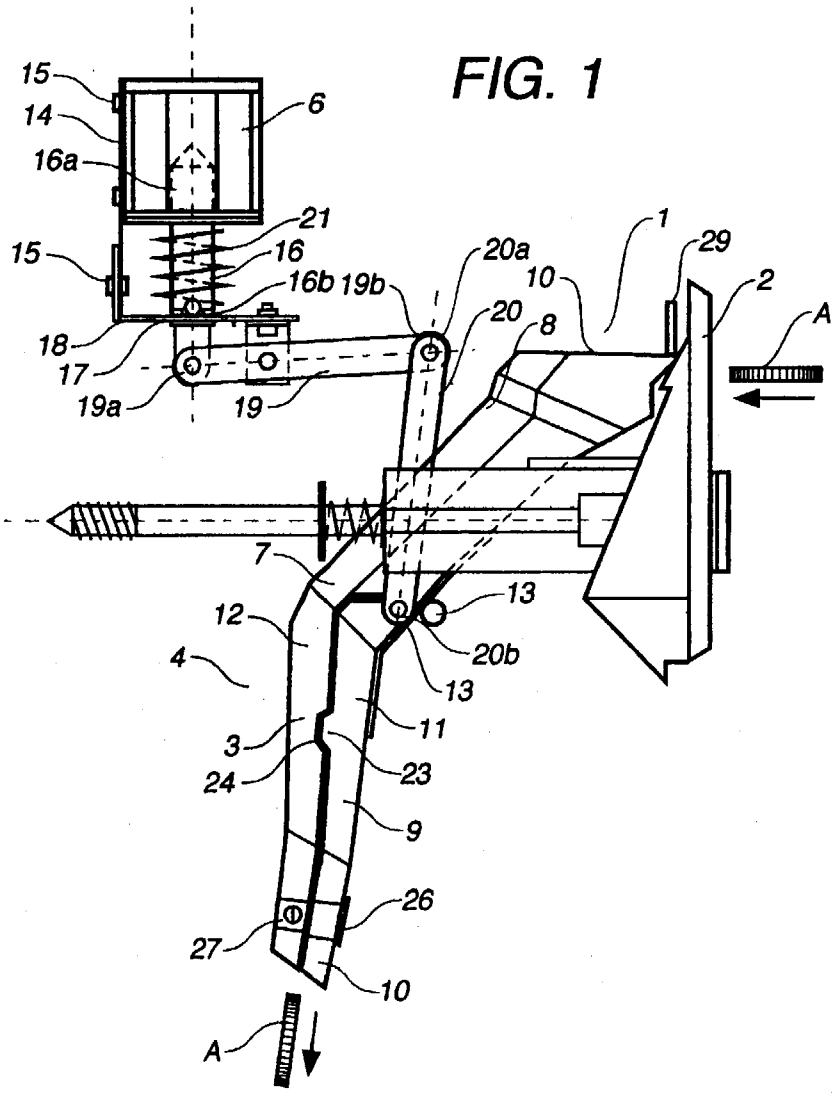
FIG. 1 is a schematic profile view illustrating an automatic product dispensing device according to the invention, equipped with unblocking means comprising a chute in closed position.

Thus, depending upon the position of rod 16, a movement of links 19 and 20 is obtained, generating the setting in motion of flap 11 of chute 3 between a closed position, such as that which is illustrated in FIG. 1, and an open position, such as the one that is illustrated in FIG. 2, permitting the release of the extraneous items and of the foreign bodies that it contains.

Furthermore, to permit suitable movement of the rod 16 between a raised position, such as the one shown in FIG. 2, and a lowered position, as shown in FIG. 1, a spring 21 having a suitable elasticity coefficient is provided on rod 16.

FIGS. 6 and 7 illustrate the operation of the unblocking means according to the present invention in an alternative form of embodiment. FIG. 6 illustrates normal operation, wherein coin A slides from entry 2 of device 1 towards entry **5*a* of coin mechanism 52. In FIG. 7, there is shown the discharge of a piece of paper B causing the blocking of the chute 8, 9, 10** and making it impossible for a coin to circulate normally. The wide opening afforded, in the order of 40° to 80°, ensures that the unblocking system has a high level of efficiency. In addition, the impact caused upon the closure of the chute, when repeated actuations are effected, enables any blocked objects to be released.

As to the fixing of chute 3, the upper portion 8 of body 7 is secured, in the vicinity of area 2 for the insertion of coins A, to a part that is integral with the front face of the housing of the dispensing device and the lower portion 10 of body 7 is, for its part, secured via rods integral with the rear face of the housing.

Furthermore, articulated flap 11 of the chute has a guide groove extending along one of its edges in order to permit and ensure optimum displacement of coin A when the chute is in closed position.

To facilitate the removal of Foreign bodies, body 7 of chute 3 is of a suitable shape and, preferably, its dimensions will be adjusted so as to ensure that unblocking functions as efficiently as possible.

In addition, to ensure adjustment of portions 11–12 of the chute, a tab 23 projecting perpendicularly to flap 11 of chute 3 can be provided, substantially in the vicinity of its end, with a view to cooperating with a cut-out 24 of a mating shape provided opposite in flap 12.

In the vicinity of the lower portion 10, at the free end of flap 11, may be fixed a supporting piece 28 on which is placed a magnet 28 designed to cooperate with a metallic part 27 secured to the free end of flap 12. Thus, via magnet any play liable to be created at links 19 and 20 in the course of their movements can be compensated for, so as to ensure that the two flaps, 11 and 12, of chute 3 can be placed in the desired position. Part 27 also makes it possible to prevent the unwanted dropping of the coins A liable to be harmful to the operation of the coin mechanism.

If appropriate, to restrict the introduction of extraneous items B, the device according to the present invention can, upstream of discharge means 4, comprise means for selecting the extraneous items and foreign bodies B.

Figure 3:
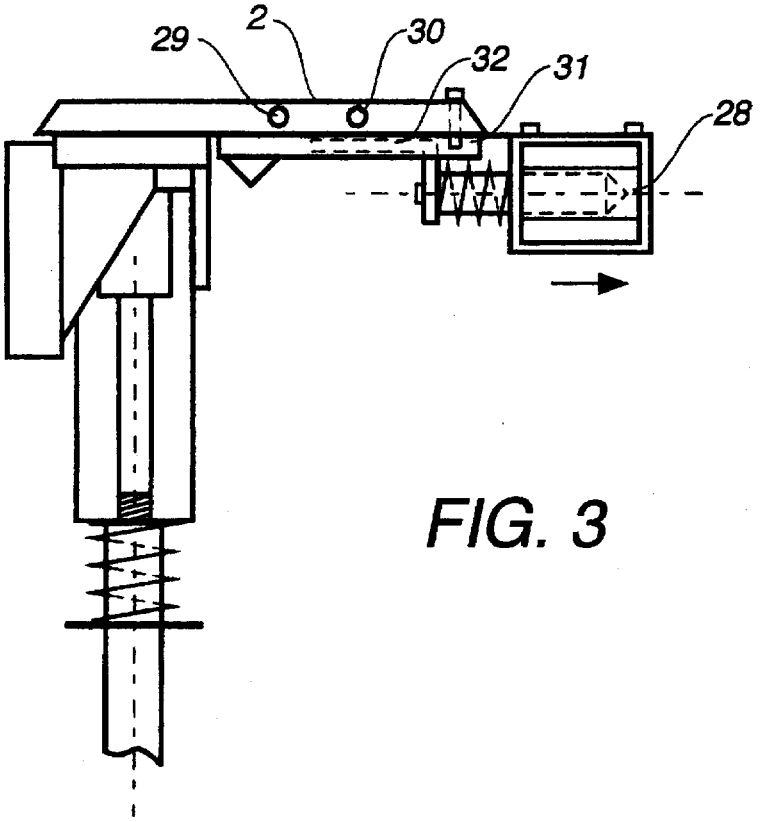
FIGS. 3 and 4 are schematic top views illustrating the selection means of the coin mechanism equipping a dispensing device according to the invention.
Figure 4:
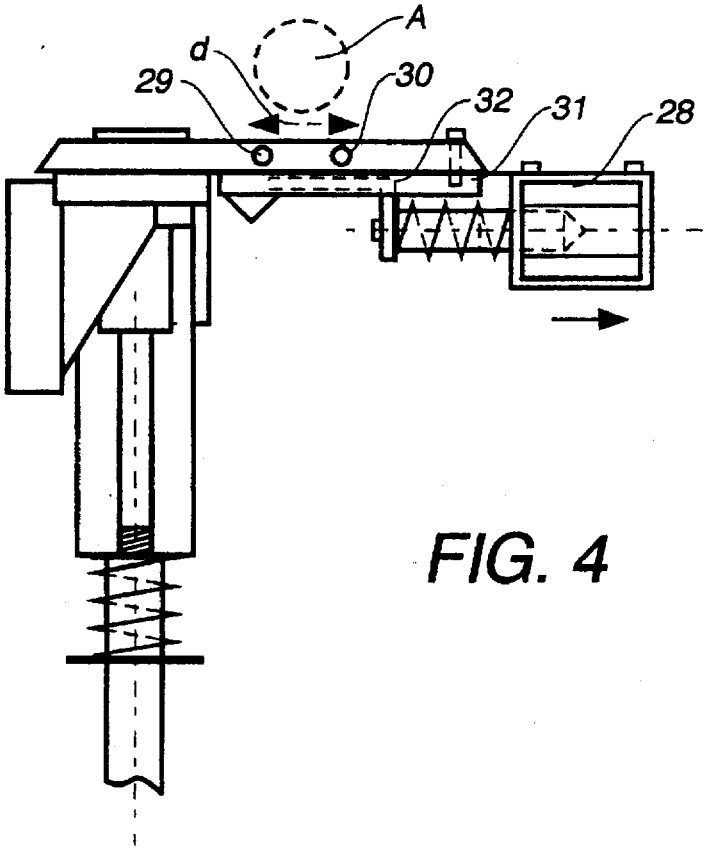

As shown in FIGS. 3 and 4, this selection means can be constituted by at least one electromagnet 28, connected to at least two magnetic sensors 29, 30 suitable for detecting the insertion of at least one coin A and which cooperate with a closure 32, mounted so as to be mobile, suitable for selectively closing a slot for the insertion of a coin A.

For this purpose, it is possible to modify the front wall of the housing of the dispensing device at area 2 for insertion of coins A by doing away, in particular, with the meters that are presently disposed on known dispensing devices. A cut-out is effected in area 2 for coins A to permit the installation of a piece to support the electromagnet, as well as a cut-out delimiting a recess designed to permit the installation of supports for sensors 29 and 30.

A riveted plate 31 is provided for re-blocking the different cut-outs resulting from the removal of the meters and, preferably, this plate 31 will have an orifice designed to permit the installation of an indicator light connected to the coin mechanism to advise the user that the latter is operational.

As to the means for checking correct operation of the device, this can be formed by at least one button 33 provided on the front face of the housing and suitable for being actuated manually to trigger operation of electromagnet 6 and/or 28. It should be noted that such a button can be replaced by a contact actuated by the coin return device of the apparatus.

Figure 5:
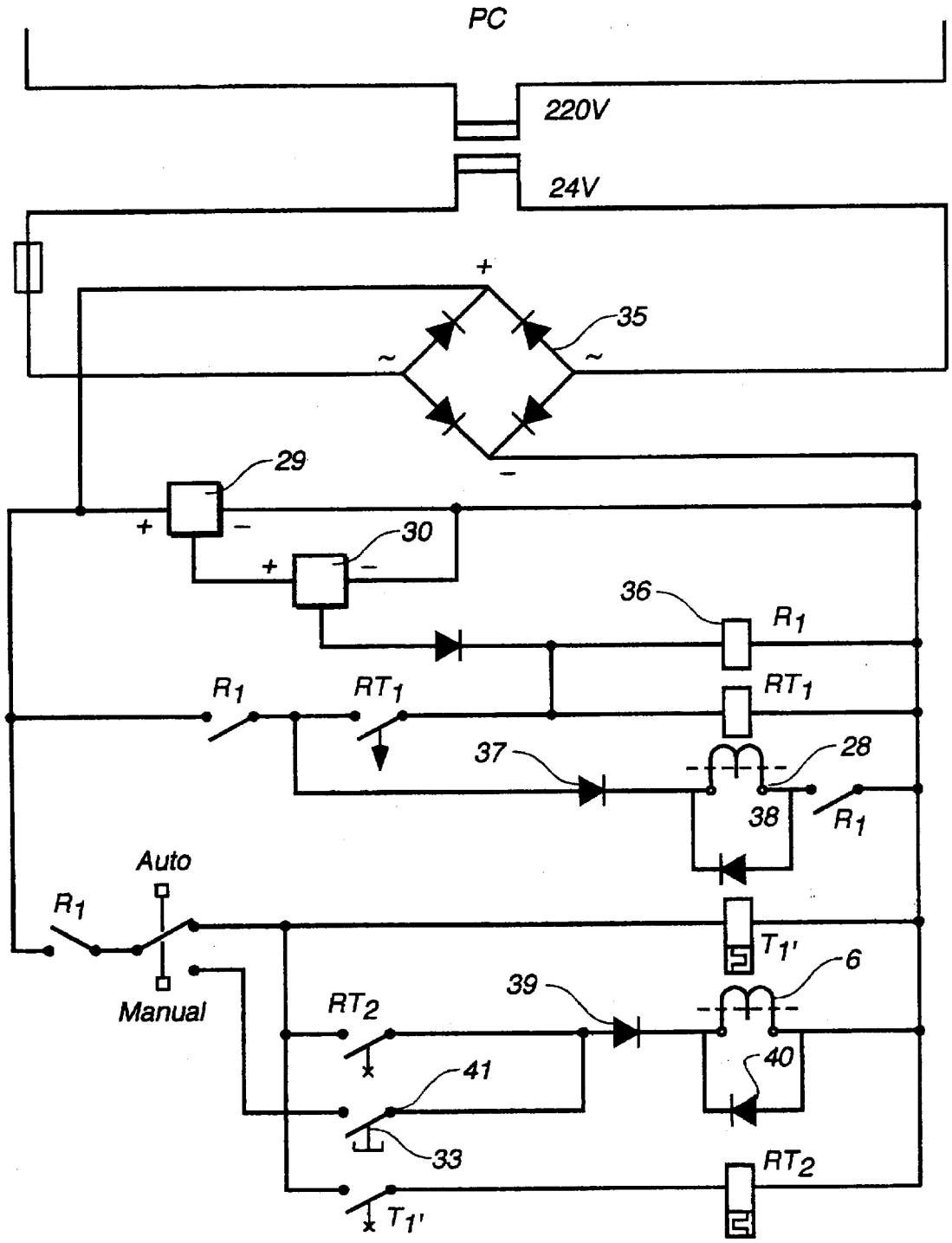
FIG. 5 illustrates an example of a circuit diagram for the electric circuit used to operate the device according to the invention.

Referring more particularly to FIG. 5, we see the diagram of an electric circuit permitting implementation of the device, by way of a non-limitative example.

The power supply of this circuit is provided by a 220V–24V transformer disposed in the lower portion of the dispensing device housing. This circuit includes a diode bridge 35 to ensure rectification of the voltage intended, in particular, to supply the electromagnets 6 and 28.

Sensor 29 is supplied, at a voltage of 24V, at the output of diode bridge 35 and it is connected to sensor 30 which operates a relay R1 36 with three inverting contacts. Two of these contacts are designed to permit the actuation of electromagnet 28, and the third contact is used to lock the automatic or manual unblocking device.

In this connection, there can be provided an automatic-manual changeover switch which selects the type of operation, that is to say automatic unblocking by periodic timed action or manual unblocking by the actuation of button 33.

The two magnetic sensors 29 and 30 are brought into action when they are both acted upon by a coin A, a token or analogous item having dimensions corresponding to the gap "d" between these two sensors. Thus, the insertion of any extraneous item not having this width will not permit actuation of these two sensors and the dispensing device will thus be protected. Of course, the gap "d" between the two sensors 29 and 30 can be varied according to requirements and the use of other types of sensor could also be contemplated according to the applications concerned.

In order to protect the electromagnet 28, a diode 37 is disposed in series, and a diode 38 is connected in parallel to prevent the self-induction effect upon cut-off.

Similarly, diodes 39 and 40 are also provided to protect electromagnet 6. Relays $RT_1$, $RT_2$, $T'_1$ are disposed to permit the bringing into operation of means for checking correct operation and constitute a timing system triggering, according to a given cycle, the operation of electromagnets 28 and 8 controlling respectively the displacement of closure 32 and that of rod 18.

It should be noted that a simpler system could be contemplated in the case of a device not comprising means of prior selection and in which systematic unblocking by timed operation was not sought after.

I claim:

1. An automatic product dispensing device comprising:

an insertion opening;

an coin inlet means for allowing a coin-like item to pass thereinto;

a dispensing means connected to said coin inlet means for dispensing a product upon receipt of the coin-like item by said coin inlet means;

a discharge means having one end connected to said insertion opening and another end disposed adjacent said coin inlet means, said discharge means for discharging a non-coin-like item passing through said insertion opening, said discharging means comprising:

a chute having a V-shaped body onto which the coin-like item can slide flat, said V-shaped body comprising:

an upper portion connected to said insertion openings;

a mid-portion having two flaps of which at least one flap is articulatable about a hinge oriented transversely to a longitudinal axis of said chute, said hinge oriented transversely to a direction of the sliding of the coin-like item along the body; and a lower portion connected to said mid-portion, said lower portion movable with said mid-portion between a first position aligned with said coin inlet means and a second position adjacent an area for receipt of the non-coin-like item;

a control means acting on the articulatable flap by a pair of linkages, said control means for actuating said linkages so as to move said mid-portion and said lower portion between 40° and 80° about said hinge so as to allow for the discharge of the non-coin-like item into said area; and a checking means connected to said control means for causing operation of said discharge means.

2. The device according to claim 1, further comprising selection means positioned upstream of the discharge means, said selection means for selecting the non-coin-like items.

3. The device according to claim 1 wherein the control means has at least one electromagnet acting upon the articulatable flap.

4. The device according to claim 3, wherein said checking means comprises at least one automatic timer for triggering the actuation of the electromagnet.

5. The device according to claim 3, wherein said checking means comprises a button adapted for being actuated manually to trigger the actuation of the electromagnet.

6. The device according to claim 2, wherein the selection means comprises at least two magnetic sensors acting upon an electromagnet cooperating with a closure means for selectively closing said insertion opening.

7. The device according to claim 3, wherein the electromagnet acts upon a rod integral with said linkages, said linkages being secured to the articulatable flap of the chute.

8. The device according to claim 1, wherein the articulatable flap of the chute comprises a perpendicularly projecting tab suitable for cooperating with a cut-out of a mating form provided in the flap.

* * * * *